US009440101B2

(12) United States Patent
Procious et al.

(10) Patent No.: US 9,440,101 B2
(45) Date of Patent: Sep. 13, 2016

(54) FLAME DISPERSANT CANISTER MOUNTING SYSTEM FOR UNDER-MICROWAVE LOCATION

(71) Applicant: Warren Watts Technology, LLC, Fort Worth, TX (US)

(72) Inventors: David C. Procious, Fort Worth, TX (US); Brent W. Williams, Fort Worth, TX (US); Michael R. Moussa, Euless, TX (US)

(73) Assignee: WARREN WATTS TECHNOLOGY, LLC, Fort Worth, TX (US)

( * ) Notice: Subject to any disclaimer, the term of this patent is extended or adjusted under 35 U.S.C. 154(b) by 257 days.

(21) Appl. No.: 14/027,316

(22) Filed: Sep. 16, 2013

(65) Prior Publication Data

US 2014/0076588 A1 Mar. 20, 2014

Related U.S. Application Data

(60) Provisional application No. 61/703,422, filed on Sep. 20, 2012.

(51) Int. Cl.

| | |
|---|---|
| ***A62C 3/00*** | (2006.01) |
| ***A62C 37/12*** | (2006.01) |
| ***A62C 99/00*** | (2010.01) |
| ***A62C 35/13*** | (2006.01) |

(52) U.S. Cl.

CPC ..... *A62C 3/006* (2013.01); *A62C 35/13* (2013.01); *A62C 37/12* (2013.01); *A62C 99/0045* (2013.01)

(58) Field of Classification Search

CPC ..... A62C 3/006; A62C 37/12; A62C 35/13; A62C 99/0045

USPC ..... 169/26, 42, 52, 57, 65, 70

See application file for complete search history.

(56) References Cited

U.S. PATENT DOCUMENTS

| | | | | |
|---|---|---|---|---|
| 3,833,063 | A | 9/1974 | Williams | |
| 3,874,458 | A | 4/1975 | Williams | |
| 3,883,306 | A | 5/1975 | Widen | |
| 5,518,075 | A | 5/1996 | Williams | |
| 6,276,461 | B1 * | 8/2001 | Stager | 169/65 |
| 7,472,758 | B1 | 1/2009 | Stevens et al. | |
| 7,610,966 | B1 | 11/2009 | Weintraub et al. | |
| 2007/0215363 | A1 * | 9/2007 | McKim et al. | 169/65 |
| 2013/0175058 | A1 | 7/2013 | Williams et al. | |

* cited by examiner

*Primary Examiner* — Steven J Ganey

(74) *Attorney, Agent, or Firm* — Bracewell LLP; Keith R. Derrington

(57) ABSTRACT

A fire extinguisher apparatus and related system is described for automatically suppressing stovetop fires. The fire extinguisher apparatus includes a canister restrained in a first location where the canister is operable to suppress fires on a rear burner of a stovetop. The canister is biased and movable to a second location where the canister is operable to suppress fires on a front burner of the stovetop. A trigger mechanism is provided for automatically moving the canister to the second location in response to a fire on the front burner. The fire extinguisher system includes an arrangement of fire extinguisher apparatuses wherein canisters are movable between the apparatuses to prevent collisions with external obstacles.

20 Claims, 5 Drawing Sheets

FLAME DISPERSANT CANISTER MOUNTING SYSTEM FOR UNDER-MICROWAVE LOCATION

BACKGROUND

1 . Related Application

This application is a non-provisional of and claims the benefit of and priority to U.S. Provisional Patent Application No. 61/703,422 titled "Flame Dispersant Canister Mounting System for Under-Microwave Location" filed Sep. 20, 2012, which is incorporated herein by reference in its entirety.

2 . Field of Invention

This invention relates in general to a canister containing a fire suppressant powder for mounting above cook stoves, and in particular to a method and apparatus for deploying the canister to dispense the fire suppressant powder to multiple cooking elements.

3 . Description of Related Art

Stovetop fires can be inadvertently ignited when, e.g., a pan of grease is left unattended on a heating element of a stove. If not promptly extinguished, a stovetop fire can spread to surrounding structures and cause significant damage and injury. To mitigate the risk of stovetop fires, automatically-activated fire extinguishing devices have been developed for mounting above a stovetop, e.g., within a range hood or under a microwave oven mounted over the stovetop. In the event of a stovetop fire, these devices typically release a fire suppressant material from a canister onto the stovetop, thereby extinguishing the fire. One example of an automatically-activated fire extinguishing device is described in commonly-owned, U.S. patent application Ser. No. 13/712,578, filed Dec. 12, 2012, now published as U.S. Patent Application Publication No. 2013/0175058, which is incorporated herein by reference in its entirety.

Often, portions of a stovetop are not directly covered by a range hood, microwave or other convenient mounting location for canisters of fire suppressant material, Automatically extinguishing fires that ignite on these portions of a stovetop presents some difficulty.

SUMMARY OF EMBODIMENTS OF THE INVENTION

In view of the foregoing, embodiments of the present invention provide systems for mounting a flame dispersant canister in a standby configuration over a first location of a stovetop. The canister is selectively movable to a deployed configuration over a second location of the stovetop in response to a fire in the second location.

According to one aspect of the disclosure, a fire extinguisher apparatus for automatically suppressing stovetop fires includes a housing with mounting fixtures for coupling the fire extinguisher apparatus—generally above a stovetop. A canister operable for automatically releasing a fire suppressant material in response to a fire adjacent the canister is movably supported by the housing between a first position with respect to the housing for extinguishing fire in a first location on the stovetop and a second position with respect to the housing for extinguishing fire in a second location on the stovetop. A restraining member operably couples the canister to housing such that the canister is restrained in the first position with respect to the housing, and the restraining member is responsive to fire in the second location on the stovetop to permit movement of the canister from the first location with respect to the housing to the second location with respect to the housing.

According to another aspect of the disclosure, a fire extinguisher apparatus includes a housing with mounting fixtures thereon for mounting the fire extinguisher apparatus in a mounting location. A hinge member is rotatably coupled to the housing, and a fuse extends through a first aperture in the housing and a second aperture in the hinge member for restraining the hinge member in a first position with respect to the housing. A biasing member operatively biases the hinge member toward a second position with respect to the housing, and a canister is coupled to the hinge member such that the canister is rotatable along with the hinge member with respect to the housing. The canister is operable to automatically release a fire suppressant material therefrom in response to fire adjacent the canister.

According to another aspect of the disclosure, a fire extinguishing system includes a left-hand fire extinguisher apparatus and a right-hand fire extinguisher apparatus operable to be mounted in respective left-hand and right-hand positions over the stovetop from the perspective of the operator facing the stovetop. Each of the left-hand fire extinguisher apparatus and the right-hand fire extinguisher apparatus includes a canister operable to automatically release a fire suppressant material therefrom in response to fire adjacent the canister, and the respective canisters are each rotatable from a respective first location to a respective second location about an arc extending between the a left-hand fire extinguisher apparatus and the right-hand fire extinguisher apparatus in response to fire at the respective second locations.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF PREFERRED EMBODIMENTS

Figure 1:
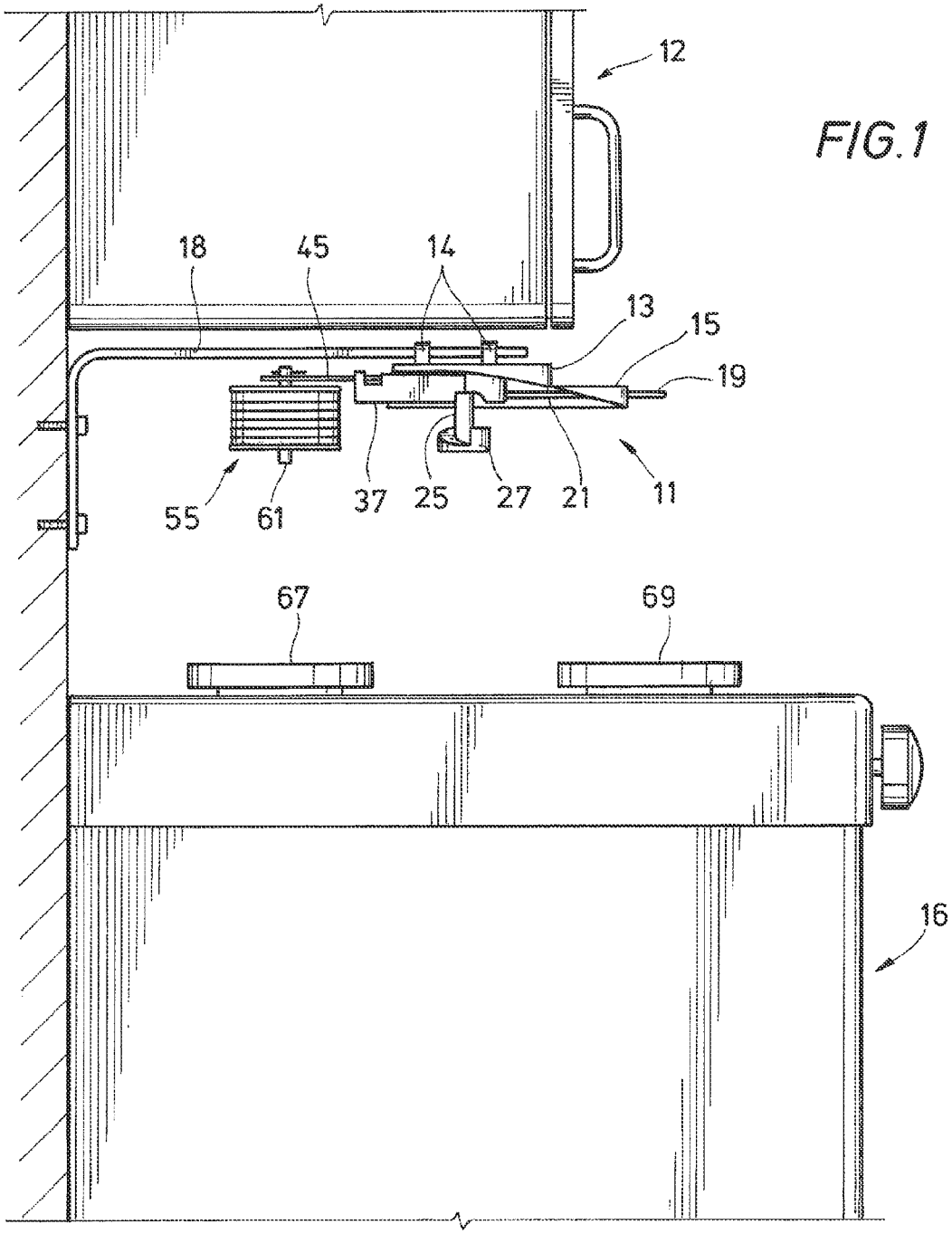
FIG. 1 is a side elevation view of a fire extinguisher apparatus constructed in accordance with an embodiment of the present disclosure, installed in one example position and arranged in a standby configuration in accordance with an embodiment of the present disclosure.

Referring to FIG. 1, an example of a fire extinguisher apparatus 11 is shown mounted in one example location under a microwave oven 12. The fire extinguisher apparatus 11 is depicted in a standby or loaded configuration, which locates an automatic fire extinguisher canister 55 over a first heating element 67, for example a rear burner on a cooking stove 16. An end of a fuse 21 is located above a second heating element 69, for example a front burner on cooking stove 16. As described in greater detail below, in response to a fire on the first heating element 67, an initiator 61 causes the fire extinguisher canister 55 to automatically operate and extinguish the fire. If, however, a fire begins on the second heating element 69, the fire will light the protruding end of fuse 21, inducing the fire extinguisher apparatus to move to a deployed configuration wherein fire extinguisher canister 55 is located substantially above second heating element 69. The fire on the second heating element 69 can then be extinguished.

Figure 3:
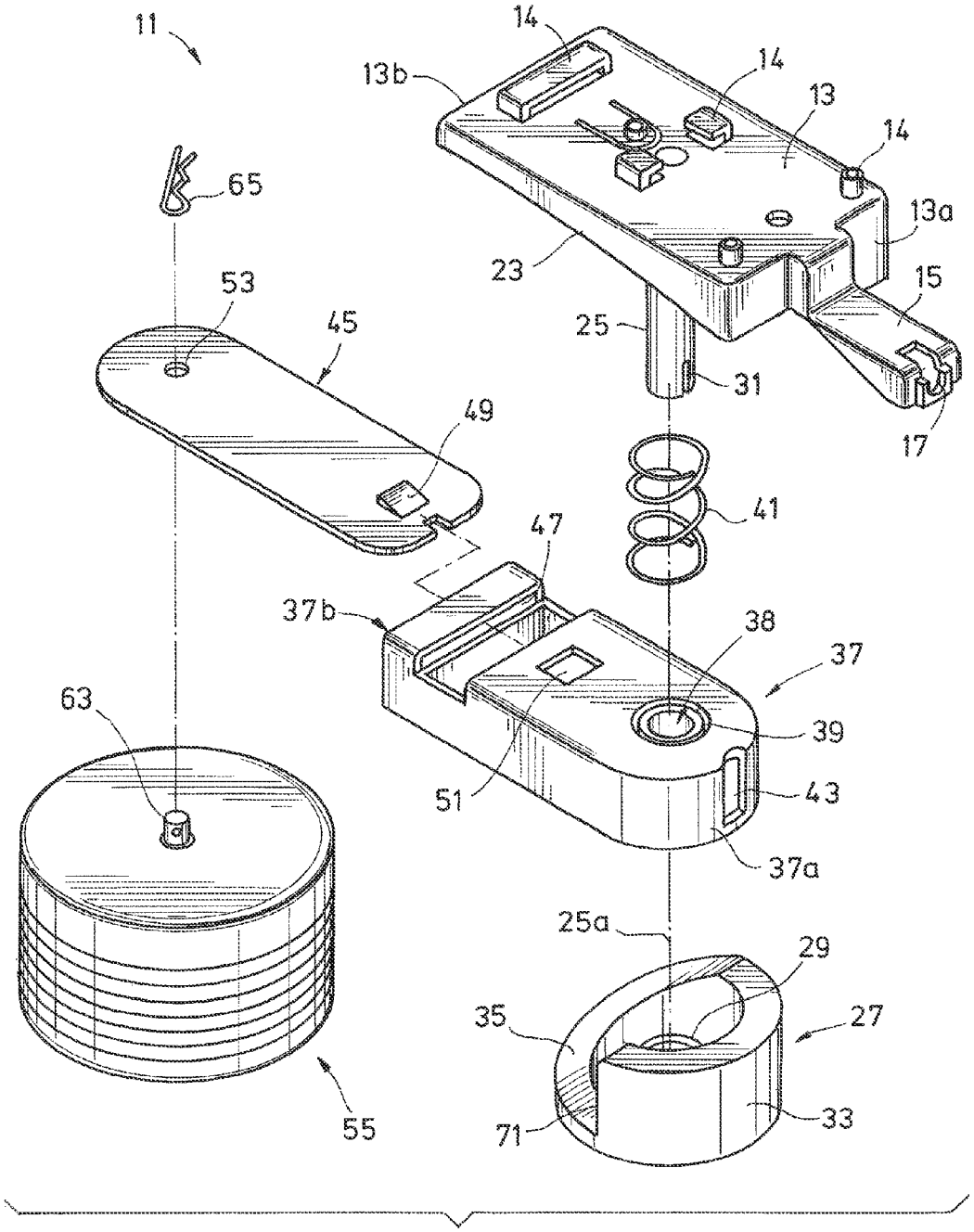
FIG. 3 is an exploded assembly view of the fire extinguisher apparatus of FIG. 1.

Fire extinguisher apparatus 11 includes a top housing 13 for securing fire extinguisher apparatus 11 to a location above a possible source of a fire such as the under-microwave location depicted. For example, top housing 13 may be mounted above a cook stove 16 using a bracket member 18 attached directly to the wall behind the stove 16 as shown in FIG. 3. Alternatively, the top housing 13 may be attached to microwave oven 12 by wires descending from a bar (not shown) that sits above vents of microwave oven.

Figure 2:
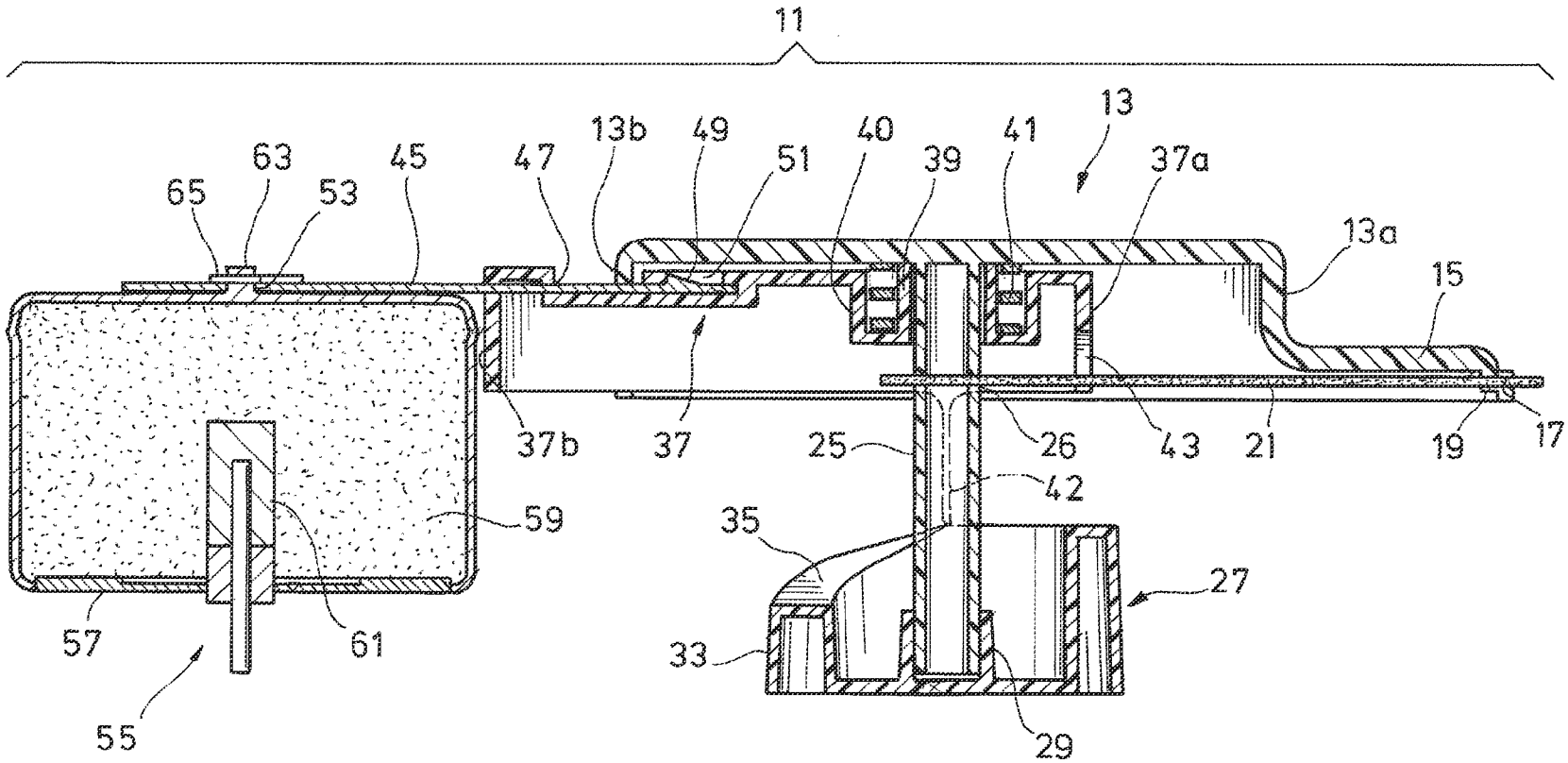
FIG. 2 is a cross-sectional view of the fire extinguisher apparatus of FIG. 1.

Referring to FIGS. 2 and 3, an upper surface of top housing 13 can include multiple mounting attachment fixtures, generally fixtures 14, to adapt to different types of vent hoods or other mounting arrangements. Top housing 13 is illustrated as having a generally planar, rectangular shaped portion with a front wall 13*a* projecting substantially perpendicularly away from an end of a shortened rear wall 13*b*. Obliquely angled side walls 23 extend along the elongate edges from lateral ends of rear wall 13*b* and taper upward from the rear wall 13*b* to a lower surface of the rectangular shaped portion. An end of top housing 13 has an extension or fuse housing 15 which is narrower both horizontally and vertically than the rest of top housing 13, and extends parallel to the elongate direction of top housing 13 from the front wall 13*a*. It is illustrated centered horizontally, and flush vertically with the lower edge of the front wall 13*a* of top housing 13. Fuse housing 15 includes an aperture 17 in its elongate direction through which a fuse assembly 19 can pass. The fuse housing 15 allows a protruding end of a fuse 21 to remain exposed past the front of fuse housing 15. As illustrated in FIG. 3, the shape of the side walls 23 allows other members of the fire extinguisher apparatus 11 free motion.

Continuing with FIGS. 2 and 3, a mandrel 25 descends vertically from top housing 13. Mandrel 25 is attached to the lower surface of the interior of top housing 13 and is substantially centrally aligned therein. The mandrel 25 is a substantially cylindrical member. Located a short distance from the inner surface of top housing 13 is an aperture 26 in the mandrel 25 through which fuse 21 passes. A bottom hinge 27 is fixedly attached to the lower end of mandrel 25 by an annular coupling 29, shown mounted on an interior lower surface hinge 27 and in which a lower end of mandrel 25 is press fit within. Bottom hinge 27 may also engage a rotational locking feature 31 on mandrel 25 to prevent any rotational movement, here illustrated as a slot in mandrel 25 (FIG. 3) into which a rib (not shown) within annular coupling 29 can fit. Bottom hinge 27 has a substantially cylindrical outer wall 33 attached by a base plate to annular coupling 29. Outer wall 33 has a top surface 35, a portion of which slopes downward toward a lower portion of bottom hinge 27. In an example, the downward slope approximates a helix. In another example, the helical profile extends along about 180° of the periphery of the outer wall 33. The helical top surface 35 is illustrated aligned so that its middle point is aligned with the sagittal mid-plane of fire extinguisher apparatus 11.

Threaded onto the mandrel 25 below top housing 13 and above bottom hinge 27 is a rotator or top hinge 37. Top hinge 37 is illustrated as having a generally planar rectangular shaped portion with a front wall 37*a* and a rear wall 37*b* projecting substantially perpendicularly away from an end of a shortened edge. Side walls are substantially rectangular and extend along the elongate edges from lateral ends of the rear wall. A front wall 37*a* of top hinge 37 is curved to join with the forward ends of the side walls and projects substantially perpendicularly away from a curved portion of the top portion of top hinge 37. An axial bore 38 extends through a planar portion of top hinge 37 and is shown girded by inner and outer bore walls 39 and 40 (FIG. 2). Bore walls 39 and 40 are illustrated as forming an annular spring channel which accepts a spring 41. Spring 41 is illustrated as a compression spring, and may be a helical torsion spring or another type of spring in other embodiments. Mandrel 25 depends downward through the axial bore 38, and top hinge 37 is rotatable with respect to the top housing 13 and hinge 27 about the axial bore 38. When top hinge 37 is in a loaded configuration, as shown in FIG. 2, spring 41 is compressed between top housing 13 and top hinge 37, exerting a downward reaction force on top hinge 37. Top hinge 37 also includes a sliding member 42 configured to engage or mesh with the helical top surface 35 of bottom hinge 27. Sliding member 42 permits at least a portion of the weight of top hinge 37 to be supported on the helical top surface 35, which is in turn, supported by top housing 13 by mandrel 25. Sliding member 42 is illustrated in FIG. 2 as a vertical rib having a lower end positioned in sliding contact with the upper end of the helical top surface 35 of the bottom hinge 27. One having ordinary skill in the art could substitute this rib for a mating helical surface, or any other geometry which would allow the top hinge 37 to slidingly contact the helical top surface 35. One having ordinary skill in the art would also understand that a helical surface could be positioned on the underside of top hinge 37, and a sliding member could be rigidly attached to mandrel 25 in other embodiments (not shown).

Formed through the curved end of top hinge 37 is a fuse aperture 43. When in a loaded configuration, as shown in FIG. 2, fuse 21 extends through apertures 17, 26, and 43. Fuse 21 therefore prevents top hinge 37 rotating about mandrel 25.

From the rectangular end of top hinge 37, a rotator arm 45 extends distally from top hinge 37. Rotator arm 45 is illustrated as a flat, planar member with a proximal end that fits into a slot 47 formed in the top surface of top hinge 37. Also illustrated, a locking tab 49 that projects upward from the upper surface of rotator arm 45 fits into a cut-out 51 in the top surface of the top hinge 37 to lock rotator arm 45 in place. The distal end of rotator arm 45 is semicircular in shape, and has an axial attachment hole 53 which passes vertically through the center point of the semicircle.

Below the distal end of rotator arm 45, an embodiment of automatic fire extinguisher canister 55 is shown attached. One having ordinary skill in the art will understand that any configuration for an automatically deploying fire extinguisher can be attached to rotator arm 45. In this embodiment canister 55 is illustrated as being a cylindrical cup-shaped member with a closed top and a bottom lid 57 attached to a lower edge of the cylindrical side wall. Other shapes are feasible. Canister 55 holds a conventional fire extinguishing powder 59 that will flow out bottom lid 57 when bottom lid 57 is opened. An initiator 61 is mounted within container 55 for opening bottom lid 57 in response to sensing flames. Canister 55 also includes a mounting pin 63 adapted to fit through hole 53 defined in rotator arm 45 and be held in place with a cotter pin 65.

Referring to FIG. 2, fuse assembly 19 includes a fuse 21 and a locking assembly. The locking assembly, not shown, may include an eyelet crimped to the fuse a distance away from the proximally protruding end of fuse 21 to expose a length of fuse 21. The eyelet and fuse 21 are pressed into a connector having legs which are adapted to be pressed into the fuse housing 15 through aperture 17. A stopper is pressed onto the legs of the connector to hold fuse assembly 19 in place when installed in fuse housing 15. Fuse 21 may be, for example, red visco fuse or any other fuse well known in the art.

Thus far, fire extinguisher apparatus 11 has been described in the loaded configuration. This is the standby position in which apparatus 11 is normally positioned after installation. As illustrated in FIGS. 2 and 3, top hinge 37 is locked in an upper position between the upper helical surface 35 and top housing 13. Spring pressure from spring 41 presses downward on top hinge 37 and causes a rotational force from the upper helical surface 35 and sliding member 42. This rotational force is counteracted by fuse 21 extending through apertures 26 and 43. The rotational force causes shear forces within fuse 21 as it is connected to the mandrel 25 on one end and the fuse housing 15 on the other through apertures 26 and 19 respectively. The shear force is not sufficient to cut fuse 21, and thus fuse 21 normally maintains the fire extinguisher apparatus 11 in the standby configuration.

When a fire on second heating element 69 (FIG. 1) ignites fuse 21, a flame front travels along fuse 21 through aperture 17 (FIG. 2), through fuse housing 15, and through aperture 43. Once the flame front passes aperture 43, the downward pressure from spring 41 is no longer restrained by fuse 21. The continued downward force of the compressed spring 41 causes a downward and rotational motion of top hinge 37. As top hinge 37 travels downward, sliding member 42 remains in sliding contact with upper helical surface 35, causing a rotation of top hinge 37 about the vertical axis 25*a* defined by mandrel 25. As rotator arm 45 and fire extinguisher canister 55 are rigidly attached to top hinge 37, they too move downward and are rotated about the vertical axis 25*a*. Top hinge 37 is arrested in its downward and rotational motion by a stop-feature of bottom hinge 27, such as a vertical wall portion 71 as illustrated in FIG. 3. In this embodiment, the upper helical surface 35 allows top hinge 37, rotator arm 45, and fire extinguisher canister 55 to traverse a 180° arc into a deployed position, wherein fire extinguisher canister 55 is positioned substantially above second heating element 69. At this time, in response to the fire, above which fire extinguisher canister 55 is disposed, initiator 61 causes the fire extinguisher canister 55 to automatically operate and extinguish the fire.

From the deployed position, the fire extinguisher apparatus 11 can be expediently reloaded. The expended fire extinguisher canister 55 is removed from rotator arm 45 by removing cotter pin 65, allowing mounting pin 63 to pass through attachment hole 53. A new fire extinguisher canister 55 is replaced and mounted to the rotator arm 45 through attachment hole 53 and secured with cotter pin 65. The non-consumed components of fuse assembly 19 are removed from aperture 17 of fuse housing 15. Rotator arm 45 and top hinge 37 are together manually moved from the deployed position to the loaded position against the spring force of spring 41. A new fuse assembly 19 is inserted through aperture 17 of fuse housing 15 so that fuse 21 also passes through apertures 43 of top hinge 37 and aperture 26 of the mandrel, thereby locking top hinge in the loaded position. As previously described, legs of fuse assembly 19 are pressed into the fuse housing 15 through aperture 17. A stopper is pressed onto the legs of the connector to hold the fuse assembly 19 in place.

Figure 4:
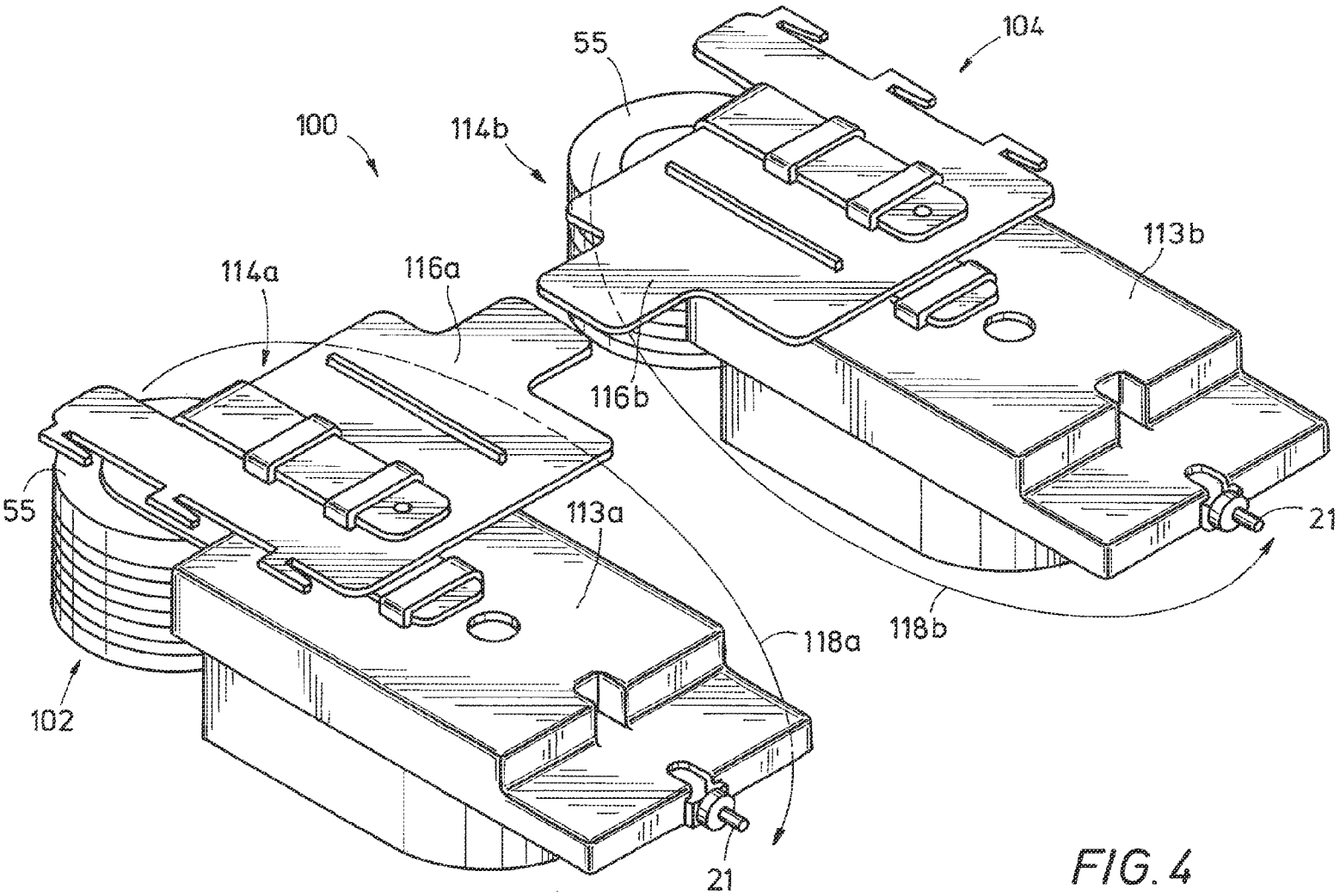
FIG. 4 a perspective view of a system of fire extinguisher apparatuses constructed in accordance with an alternate embodiment of the present disclosure, the system of fire extinguisher apparatuses including a right-hand fire extinguisher apparatus and a left-hand fire extinguisher apparatus arranged for side-by-side installation and operation.

Referring now to FIG. 4, according to an alternate embodiment of the present disclosure, a system 100 comprises a side-by-side installation arrangement for a left-hand fire extinguisher apparatus 102 and a right-hand fire extinguisher apparatus 104. As depicted, both fire extinguisher apparatuses 102, 104 are in a loaded or standby configuration. The system 100 facilitates cooperative use, for example, of the right and left hand fire extinguisher apparatuses 102, 104 arranged over a cook stove (not shown) with four heating elements. Each fire extinguisher apparatus 102, 104 includes a fire extinguisher canister 55 for positioning over respective a first location such as a respective rear heating element. An exposed portion of fuse 21 is provided for positioning over a second location such as a respective front heating element. The left-hand fire extinguisher apparatus 102 includes a top housing 113*a* coupled to mounting attachment fixtures 114*a* configured for coupling the fire extinguisher apparatus 102 on a left-hand side of a stovetop from the perspective of an operator facing the stovetop. Similarly, the right-hand fire extinguisher apparatus 102 includes top housing 113*b* coupled to mounting attachment fixtures 114*b* configured for coupling the fire extinguisher apparatus 102 on a right-hand side stovetop from the perspective of an operator facing the stovetop. When the fire extinguisher apparatuses 102, 104 are mounted in this manner, mounting plates 116*a*, 116*b* protrude inwardly from top housings 113*a*, 113*b*, ensuring that a sufficient clearance is maintained between the fire extinguisher apparatuses 102, 104.

In operation, the canisters 55 are operable to extinguish a fire on either of the rear burners in the standby or loaded configuration depicted. A fire on either of the front burners will ignite fuse 21, thereby releasing canisters 55 from the standby configuration over the first position. Fire extinguisher apparatuses 102, 104 are configured such that, once released, canisters 55 traverse an arc from over the first position to over the second position as illustrated by arrows 118*a*, 118*b*. Each of the canisters 55 travels on an interior of the system 100 between the fire extinguisher apparatuses 102, 104, so not to be impeded by obstacles (not shown) such as cabinets or other appliances that may be placed on lateral side of the system 100.

Figure 5:
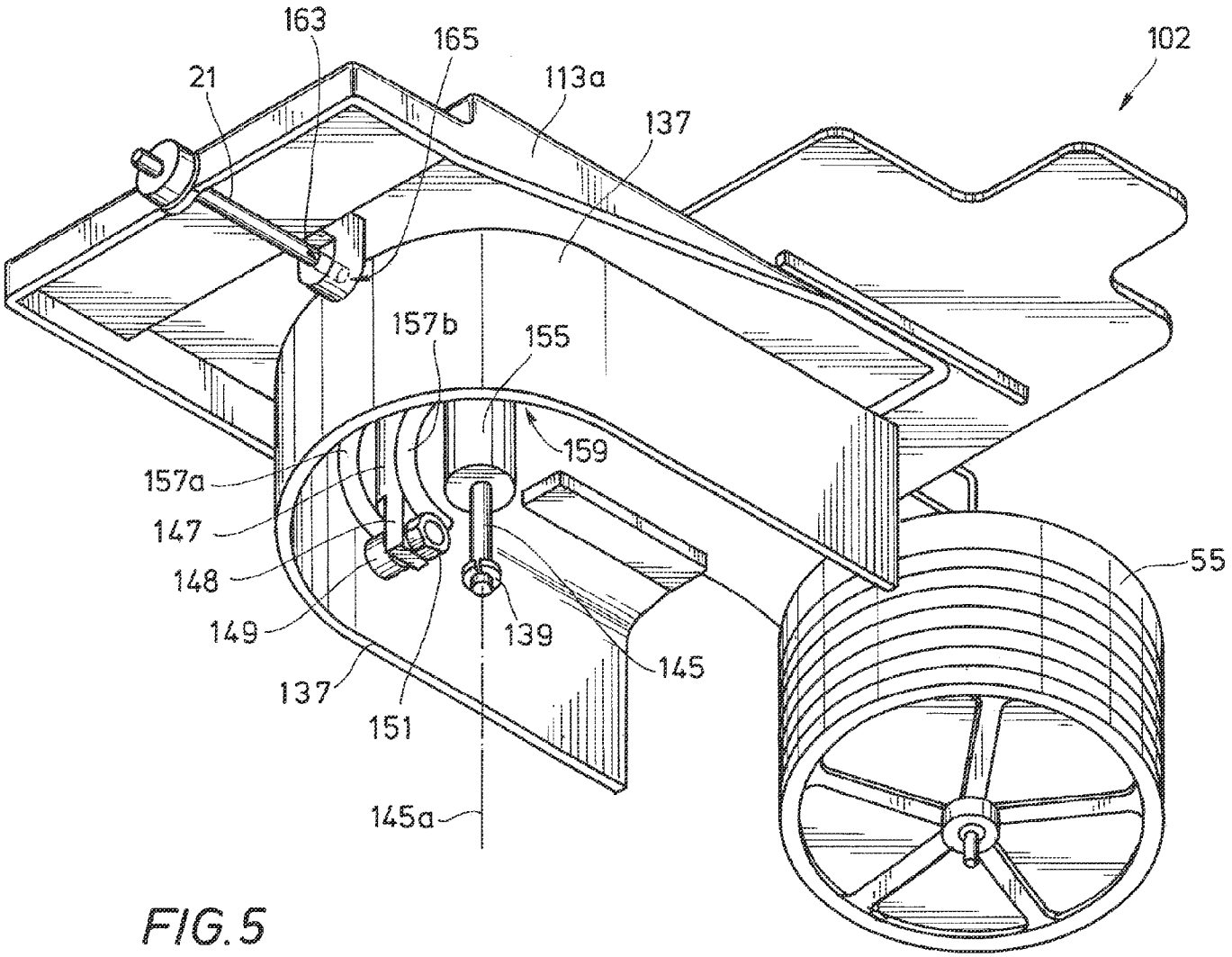
FIG. 5 is a perspective view of an underside of the left-hand fire extinguisher apparatus of FIG. 4.

Referring now to FIG. 5, an underside of left-hand fire extinguisher apparatus 102 is depicted. Canister 55 is mounted for rotation with a top hinge 137 about an axis 145*a* defined by a mandrel 145. Mandrel 145 depends downwardly from top housing 113*a*, and supports a e-clip 139 or similar fastener at a lower end thereof. Also depending downwardly from top housing 113*a* is a vertical rib 147. A lower protrusion 148 extending from the vertical rib 147 supports a roller 149 fastened by a hex nut 151.

The top hinge 137 includes a bearing tube 155 disposed about mandrel 145 and cylindrically-shaped walls 157*a*, 157*b* disposed on opposing sides of vertical rib 147. Portions of the curved, cylindrically-shaped walls 157*a*, 157*b* slope upward toward a ceiling 159 of top hinge 137. A first cylindrically-shaped wall 157*a* rests on roller 149 supporting the weight of top hinge 137 and canister 55. A second cylindrically-shaped wall 157*b* is similarly sloped so as to provide clearance for relative motion between the second cylindrically-shaped wall 157*b* and hex nut 151. The top hinge 137 is rotationally restrained with respect to top housing 113*a* by fuse 21 extending through a fuse aperture 163 defined in top housing 113 and a fuse aperture 165 defined in top hinge 137.

In operation, as described above, a fire on a front burner in the second location ignites fuse 21 to release canister 55. Once a sufficient portion of fuse 21 is consumed by fire, the rotational restraint defined between fuse apertures 163 and 165 is severed, and the top hinge 137 is free to rotate with respect to top housing 113*a* about axis 145*a*. In some embodiments, gravity alone propels cylindrically-shaped wall 157*a* over roller 149 as canister 55 traverses the arc illustrated arrow 118*a*. In other embodiments, a spring or other biasing member (not shown) may be provided to assist gravity in moving canister 55 in the direction of arrow 118*a*. For instance, a compression spring housed within bearing tube 155 may provide a biasing force between top housing 113*a* and top hinge 137, tending to separate top housing 113*a* and top hinge 137 along axis 145*a*. The relative rotational. motion between top housing 113*a* and top hinge 137 may be arrested by engagement of the bearing tube 155 and e-clip 139, or engagement of roller against a stop member (not shown) disposed at an upper end of cylindrically-shaped wall 157*a*, or by another mechanism. Once the rotational motion is arrested, canister 55 is appropriately positioned over the second position to extinguish a fire on a front burner.

As will be appreciated by those skilled in the art, right-hand fire extinguisher apparatus 104 (FIG. 4) operates in a similar manner. Mirror-image parts may be provided such that canister 55 on either fire extinguisher apparatus 102, 104 initially traverses an arc toward the other fire extinguisher apparatus, 102, 104 once the rotational restraint provided by fuse 21 is severed.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A fire extinguisher apparatus for suppressing a fire comprising:

a housing comprising mounting fixtures thereon for coupling the fire extinguisher apparatus generally above a stovetop;

a mandrel depending from the housing;

a canister operable for automatically releasing a fire suppressant material therefrom in response to a fire adjacent the canister, the canister movably supported by the housing between a first position with respect to the housing for extinguishing fire in a first location on the stovetop and a second position with respect to the housing for extinguishing fire in a second location on the stovetop;

a bottom hinge coupled to the mandrel distal from the housing and that comprises a helical top surface;

a top hinge coupled to the canister and having a sliding member that interfaces with the helical top surface; and a restraining member operably coupled to the canister for restraining the canister in the first position with respect to the housing and responsive to fire in the second location on the stovetop to permit movement of the canister from the first location with respect to the housing to the second location with respect to the housing, so that when the restraining member is removed the top hinge is rotated about the mandrel to swing the canister into the second position.

2. The fire extinguisher apparatus of claim 1, wherein an end of the sliding member that interfaces with the helical top surface slides along a length of the helical top surface when the canisters swings into the second position.

3. The fire extinguisher apparatus of claim 1, wherein the restraining member comprises a fuse extending through a first aperture in the housing and a second aperture in the hinge member for prohibiting relative motion between the hinge member and the housing and restraining the canister in the first position with respect to the housing, and wherein the fuse is consumable by fire in the second location to permit relative motion between the hinge member and the housing.

4. The fire extinguisher apparatus of claim 3, wherein the canister is biased by gravity to the second position with respect to the housing.

5. The fire extinguisher apparatus of claim 1, further comprising a spring that exerts a biasing force against the upper hinge in a direction away from the housing.

6. The fire extinguisher apparatus of claim 1, wherein the sliding member comprises a roller that interfaces with the helical top surface.

7. A fire extinguisher apparatus comprising:

a housing comprising mounting fixtures thereon for mounting the fire extinguisher apparatus in a mounting location;

a hinge member rotatably coupled to the housing;

a canister coupled to the hinge member such that the canister is rotatable along with the hinge member with respect to the housing from over a second location, the canister operable to automatically release a fire suppressant material therefrom in response to fire adjacent the canister;

a fuse extending through a first aperture in the housing and a second aperture in the hinge member for restraining the hinge member in a first position with respect to the housing, and the fuse having a portion that extends generally over the second location;

a biasing member operatively coupled to the hinge member for biasing the hinge member toward the second position with respect to the housing; and a fuse housing having the portion of the fuse that extends generally over the second location, so that when the fuse is combusted in response to a flame proximate the second location, the canister rotates to over the second location.

8. The fire extinguisher apparatus of claim 7, wherein the canister is rotatable from over a first location to over a second location in response to rotation of the hinge member from the first position to the second position.

9. The fire extinguisher apparatus of claim 8, wherein the fuse comprises a first fuse, and wherein the canister is equipped with a second fuse in communication housing comprises a fuse with an initiator for opening a bottom lid on the canister and release the fire suppressant material.

10. The fire extinguisher apparatus of claim 7, wherein biasing member is a spring operably coupled between the hinge member and the housing.

11. The fire extinguisher apparatus of claim 10, wherein the spring is a compression spring biasing the hinge member away from the housing in a vertical direction.

12. The fire extinguisher apparatus of claim 7, wherein the a hinge member is rotatable about an axis with respect to the housing, wherein one of the hinge member and housing comprises a generally cylindrical wall disposed about the axis, and wherein at least a portion of a weight of the hinge member is supported by the housing along the generally cylindrical wall during movement of the hinge member from the first position to the second position.

13. The fire extinguisher apparatus of claim 12, wherein the generally cylindrical wall comprises a sloped circumferential surface, and wherein the hinge member comprises a sliding member biased to engage the generally sloped circumferential surface.

14. The fire extinguisher apparatus of claim 13, wherein the generally cylindrical wall is supported by the housing by a mandrel extending through the hinge member.

15. A fire extinguishing system comprising:

a left-hand fire extinguisher apparatus operable to be mounted in a left hand position over a stovetop from the perspective of an operator facing the stovetop; and a right-hand fire extinguisher apparatus operable to be mounted in a right-hand position over the stovetop from the perspective of the operator facing the stovetop;

wherein each of the left-hand fire extinguisher apparatus and the right-hand fire extinguisher apparatus comprises a canister operable to automatically release a fire suppressant material therefrom in response to fire adjacent the canister, and wherein the respective canisters are each rotatable from a respective first location to a respective second location about an arc extending between the left-hand fire extinguisher apparatus and the right-hand fire extinguisher apparatus in response to fire at the respective second locations.

16. The fire extinguishing system of claim 15, where each of the left-hand fire extinguisher apparatus and the right-hand fire extinguisher apparatus comprises a respective mounting plate extending over the arc about which the respective canister is rotatable such that the respective mounting plates prohibit mounting the left-hand fire extinguisher apparatus and the right-hand fire extinguisher with insufficient clearance for movement of the respective canisters.

17. The fire extinguisher system according to claim 15, wherein the respective first locations are rear heating elements of the stovetop and wherein the respective second locations are front heating elements of the stovetop.

18. The fire extinguisher system according to claim 15, wherein the respective canisters are operatively restrained in the respective first locations by a fuse, and wherein the canisters are operable to move to the respective second locations in response to the fuse being at least partially consumed by fire.

19. A fire extinguisher system comprising:

a canister containing fire extinguishing powder that comprises an ignitable fuse in communication with an initiator, and a frangible bottom lid, so that when the fuse ignites in response to a flame on the cooking stove, the initiator ignites to open the bottom lid and release the fire extinguishing powder;

an arm having an end coupled to the canister that is above front and rear burners on a cooking stove, and that is rotatable from a first orientation so that the canister is disposed directly above a one of the front or rear burners, to a second orientation so that the canister is disposed above the other one of the front or rear burners; and an ignitable member in interfering contact with the arm to retain the arm in the first orientation, so that when the ignitable member is ignited, the ignitable member is not in interfering contact with the arm and the arm rotates into the second orientation.

20. The fire extinguishing system of claim 19, further comprising a rotating system that rotates the arm from the first to the second orientation in response to a flame on a one of the first or second burners that is distal from the canister when the arm is in the first orientation.

* * * * *